US010600346B2

(12) United States Patent
Kim et al.

(10) Patent No.: US 10,600,346 B2
(45) Date of Patent: Mar. 24, 2020

(54) DISPLAY DRIVING DEVICE

(71) Applicant: SAMSUNG ELECTRONICS CO., LTD., Suwon-si (KR)

(72) Inventors: Kyong Ho Kim, Hwaseong-si (KR); Young Min Choi, Yongin-si (KR); Dong Hoon Baek, Seoul (KR); Jae Youl Lee, Hwaseong-si (KR); Hyun Wook Lim, Seoul (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 226 days.

(21) Appl. No.: 15/454,062

(22) Filed: Mar. 9, 2017

(65) Prior Publication Data

US 2018/0068600 A1 Mar. 8, 2018

(30) Foreign Application Priority Data

Sep. 2, 2016 (KR) ..... 10-2016-0113129

(51) Int. Cl.
*G09G 3/36* (2006.01)
*G09G 3/00* (2006.01)
*G09G 3/20* (2006.01)

(52) U.S. Cl.
CPC ..... *G09G 3/006* (2013.01); *G09G 3/2096* (2013.01); *G09G 3/3688* (2013.01); *G09G 2330/06* (2013.01); *G09G 2330/12* (2013.01); *G09G 2370/04* (2013.01); *G09G 2370/08* (2013.01)

(58) Field of Classification Search
CPC .... G09G 3/006; G09G 3/3258; G09G 3/3266; G09G 2330/06; G09G 2330/12; G09G 2310/08; G09G 2310/0286
USPC ..... 345/98, 100, 204
See application file for complete search history.

(56) References Cited

U.S. PATENT DOCUMENTS 5,341,399 A * 8/1994 Eguchi ..... H04N 17/004 324/76.11
7,024,601 B2 4/2006 Quinlan et al.
7,646,805 B2 1/2010 Cho
8,321,732 B2 11/2012 Warner et al.
8,775,879 B2 7/2014 Oh et al.
8,878,828 B2 11/2014 Baek et al.
9,099,023 B2 8/2015 Baek et al.
9,129,551 B2 9/2015 Kim et al.
2005/0259099 A1* 11/2005 Jo ..... G09G 3/3291 345/211
2010/0077211 A1 3/2010 Lee
2012/0146965 A1* 6/2012 Baek ..... G09G 3/006 345/204
2012/0166896 A1 6/2012 Oh et al.
(Continued)

FOREIGN PATENT DOCUMENTS

JP 5154585 B2 2/2013
KR 10-0224836 B1 10/1999
(Continued)

*Primary Examiner* — Jennifer T Nguyen
(74) *Attorney, Agent, or Firm* — Sughrue Mion, PLLC

(57) ABSTRACT

A display driving device includes a timing controller configured to generate test data having a predetermined periodicity, and a source driver configured to drive source lines of a display panel using the test data, determine that a bit error has been generated when aperiodicity appears in the test data, and measure a bit error rate (BER) based on the bit error.

12 Claims, 9 Drawing Sheets

(56) References Cited

U.S. PATENT DOCUMENTS

| | | | | |
|---|---|---|---|---|
| 2013/0036335 | A1* | 2/2013 | Kim | G09G 3/006 714/704 |
| 2013/0050176 | A1 | 2/2013 | Kim et al. | |
| 2013/0285998 | A1 | 10/2013 | Hong et al. | |

FOREIGN PATENT DOCUMENTS

| | | | |
|---|---|---|---|
| KR | 10-1187571 | B1 | 10/2012 |
| KR | 10-2013-0022159 | A | 3/2013 |
| KR | 10-2015-0109569 | A | 10/2015 |

* cited by examiner

DISPLAY DRIVING DEVICE

CROSS-REFERENCE TO RELATED APPLICATION

This application claims priority from Korean Patent Application No. 10-2016-0113129 filed on Sep. 2, 2016 in the Korean Intellectual Property Office, the disclosure of which is incorporated herein by reference in its entirety.

BACKGROUND

1. Field

Methods and apparatuses consistent with example embodiments relate to a display driving device.

2. Description of Related Art

As resolution and size of display panels increase, a signal sent by and received in a display driving device may be increasingly affected by electromagnetic wave interference, signal delay or the like, and an error may occur therefrom. A display driving device may perform an inspection of a bit error rate (BER) to determine whether a signal has been normally sent and received. The inspection of a bit error rate may be performed by determining whether data output by a timing controller is matched with data received by a source driver.

SUMMARY

One or more example embodiments may provide a display driving device that effectively specifies a source driver experiencing abnormal conditions or performance.

According to an aspect of an example embodiment, there is provided a display driving device including: a timing controller configured to generate test data having a predetermined periodicity; and a source driver configured to drive source lines of a display panel using the test data, determine that a bit error has been generated when aperiodicity appears in the test data, and measure a bit error rate based on the bit error.

According to an aspect of another example embodiment, there is provided a display driving device including: a plurality of source drivers configured to drive source lines of a display panel; and a timing controller connected to the plurality of source drivers through a single shared back channel, the timing controller being configured to receive identification information through the single shared back channel, and identify a source driver of the plurality of source drivers in which abnormal conditions occur based on the identification information.

According to an aspect of yet another example embodiment, there is provided a source driver configured to drive a plurality of source lines of a display panel, the source driver including: a receiver configured to receive test data; a decoder configured to generate pixel data for each of the plurality of source liens based on the test data; and an error detector configured to determine periodicity of the pixel data and determine whether the source driver is operating in an abnormal state based on the periodicity.

BRIEF DESCRIPTION OF DRAWINGS

The above and other aspects, features and other advantages will be more clearly understood from the following detailed description taken in conjunction with the accompanying drawings, in which.

DETAILED DESCRIPTION

Example embodiments will now be described in detail with reference to the accompanying drawings.

Figure 1:
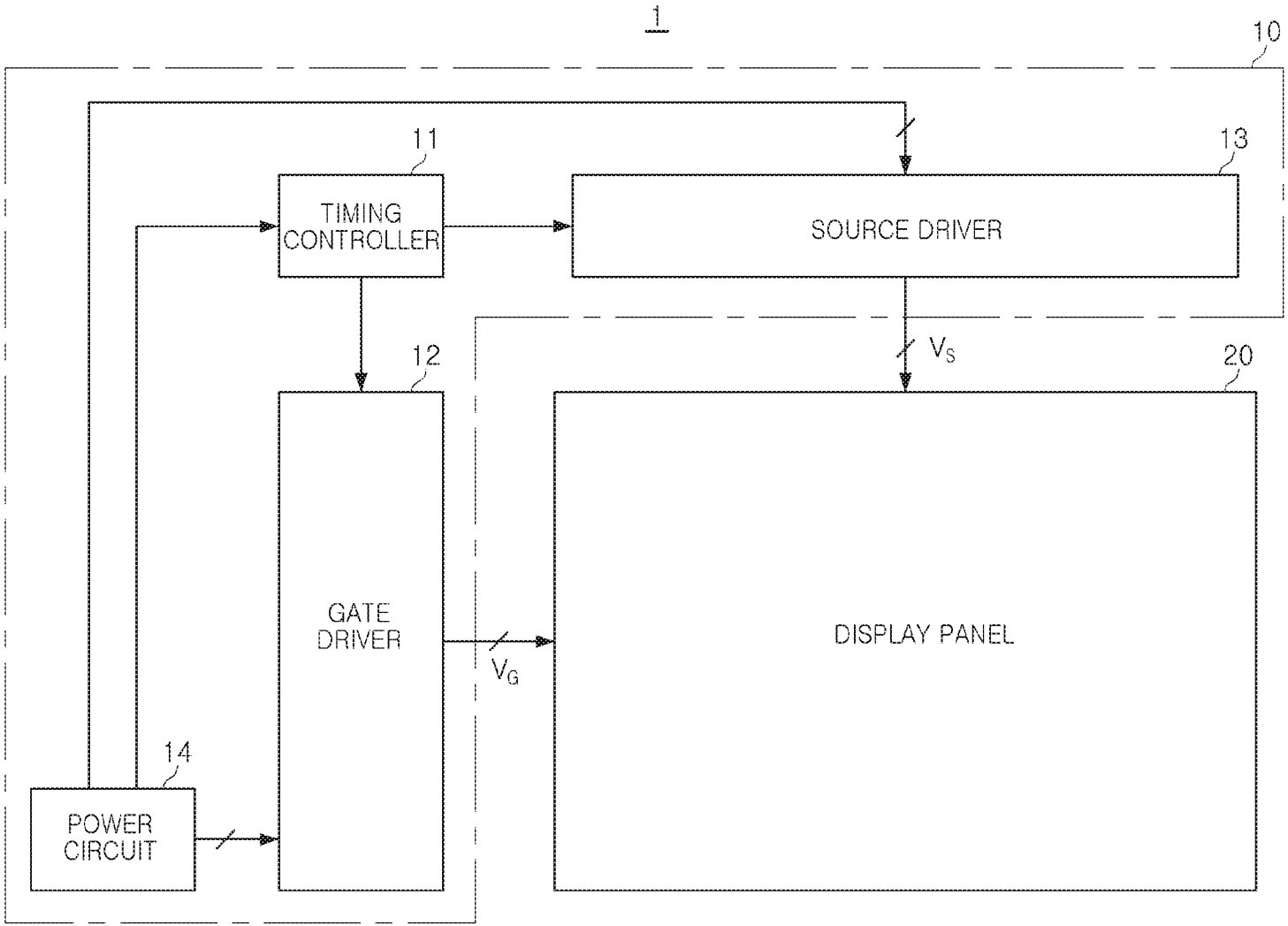
FIGS. 1 and 2 are drawings illustrating a display device according to an example embodiment.
Figure 2:
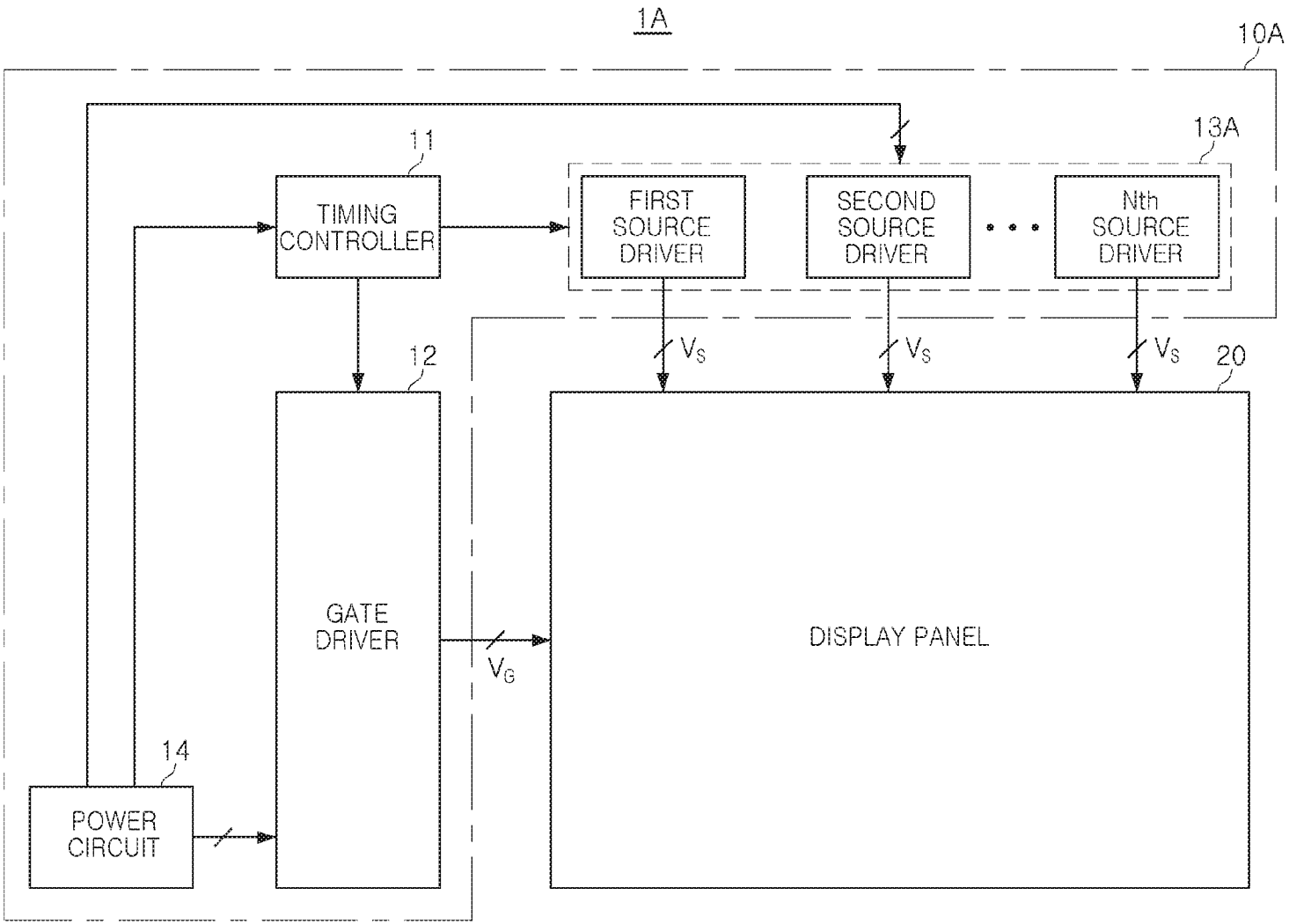

FIGS. 1 and 2 are drawings illustrating a display device according to an example embodiment.

With reference to FIG. 1, a display device 1 according to an example embodiment may include a timing controller 11, a gate driver 12, a source driver 13, a power circuit 14, and a panel 20. The timing controller 11, the gate driver 12, the source driver 13, and the power circuit 14 may be included in a display driving device 10.

The panel 20 may include at least one transparent substrate, and a plurality of gate lines and a plurality of source lines may be disposed on the transparent substrate to intersect each other. A plurality of pixels may be defined at intersection points of the plurality of gate lines and the plurality of source lines. Each pixel may include a transistor and a capacitor, and a gate electrode and a source electrode of the transistor may be connected to a gate line and a source line, respectively. The capacitor may be connected to a drain electrode of the transistor, and may include a storage capacitor. When the display device 1 is a liquid crystal display (LCD) device, a liquid crystal capacitor may also be connected to the drain electrode of the transistor.

The timing controller 11 may receive image data transferred from an external source, may generate image data based on a control signal transferred from an external source or the like. The timing controller 11 may generate a signal for controlling the gate driver 12 and the source driver 13 to provide signals to a plurality of gate lines and a plurality of source lines.

The gate driver 12 may sequentially scan a plurality of gate lines based on a control signal transferred from the timing controller 11. In an example embodiment, the gate driver 12 may select at least one of the plurality of gate lines to input a gate power voltage $V_G$ thereto, and a gate line receiving the gate power voltage $V_G$ may be activated. The source driver 13 may input a source voltage $V_S$ for displaying an image to a source line intersecting the gate line activated by the gate power voltage $V_G$.

The source driver 13 may output the source voltage $V_S$ based on a control signal transmitted by the timing controller 11 to drive the plurality of source lines. The source voltage $V_S$ is an analog signal required for displaying an image, and may be a gradation voltage. The source voltage $V_S$ may be applied to a source line intersecting the gate line activated by receiving the gate power voltage $V_G$ by the gate driver 12. Thus, in the order in which the gate driver 12 scans the plurality of gate lines, an image may be displayed.

The power circuit 14 may generate various internal power voltages required for operations of the display device 1, based on an external power voltage supplied from an external source. The power circuit 14 may include a charge pump circuit or the like for generating the internal power voltages. As an example embodiment, the power circuit 14 may generate the gate power voltage $V_G$ required for driving a gate line based on an external power voltage. At least a portion of the gate power voltage $V_G$ may have a value different from an external power voltage.

With reference to FIG. 2, a display device 1A according to an example embodiment may include a display driving device 10A and a panel 20. According to an example embodiment, as illustrated in FIG. 2, a source driver 13A of the display driving device 10A may include first to Nth source drivers. The first to Nth source drivers may be disposed in parallel inside the source driver 13A, and each of the first to Nth source drivers may drive different source lines. A display device with multiple source drivers may be used for a relatively larger display device.

Figure 3:
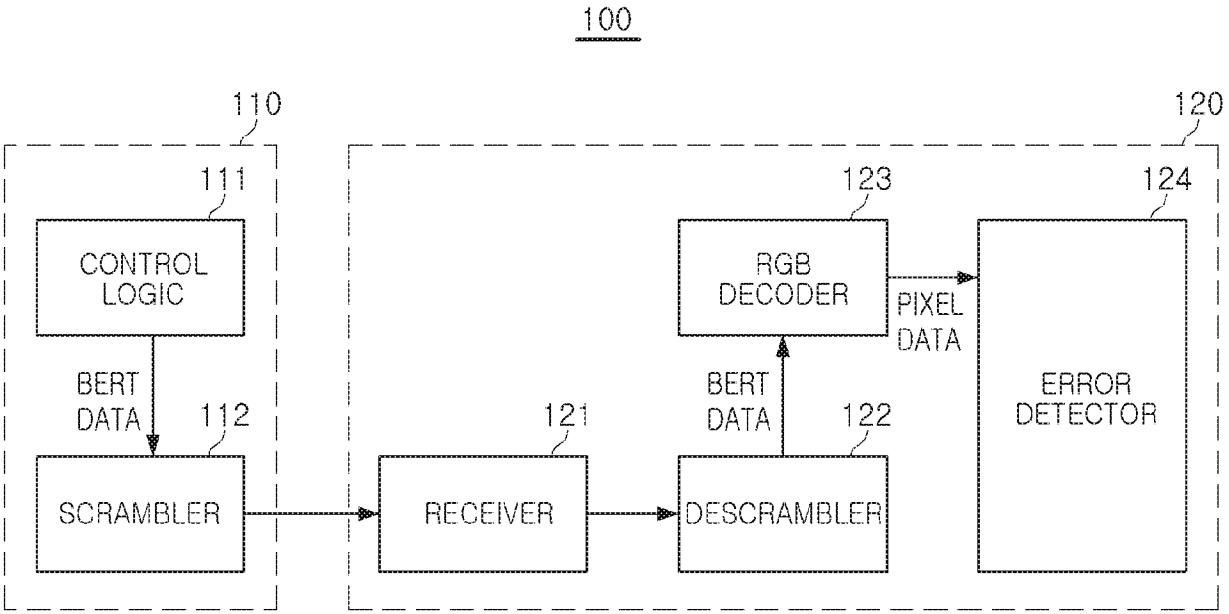
FIG. 3 is a block diagram illustrating a display driving device according to an example embodiment.

FIG. 3 is a block diagram illustrating a display driving device according to an example embodiment.

With reference to FIG. 3, a display driving device 100 according to an example embodiment may include a timing controller 110 and a source driver 120. In a performance evaluation step, the timing controller 110 may generate test data having predetermined periodicity to be transmitted to the source driver 120. The source driver 120 may evaluate periodicity of the test data received from the timing controller 110, and may count aperiodicity occurrences, which indicate a bit error, to measure a bit error rate (BER). In an example embodiment, the bit error rate may be measured in an interface included in the source driver 120 to intermediate communications between the source driver 120 and the timing controller 110.

With reference to FIG. 3, the timing controller 110 may include a control logic 111 and a scrambler 112. The control logic 111 may generate data required for driving source lines by the source driver 120 or may receive the data described above from an external source. According to an example embodiment, when the display driving device 100 is operated in a test mode, the control logic 111 may output test data BERT DATA for checking a bit error rate. Test data BERT DATA may have a periodicity determined based on an operating environment of the display driving device 100, by characteristics of a panel connected to the display driving device 100, or the like. In other words, even in the case of the same display driving device 100, when display driving devices are expected to be operated in different operating environments or to be connected to panels having different characteristics, the control logic 111 may output portions of test data BERT DATA having different periodicity.

Test data BERT DATA output by the timing controller 110 may correspond to a source voltage to be output by the source driver 120 when the display driving device 100 is operated in a worst case situation. The worst case situation may be a case in which a load of the source driver 120 has a maximum value, while the source driver 120 outputs a source voltage using test data BERT DATA. In other words, test data BERT DATA may be data which will significantly increase a load of the source driver 120 intentionally. In an example embodiment, while the source driver 120 outputs a source voltage using test data BERT DATA, power consumption of the source driver 120 is close to a maximum value, or a voltage of an amplifier outputting a source voltage may have a maximum variation range.

In an example embodiment, when the source driver 120 drives a source line of a display panel using test data BERT DATA, a test screen having uniform periodicity may be displayed in a panel of a display device. The periodicity of the test screen may depend on the periodicity of test data BERT DATA, and the periodicity of test data BERT DATA may be determined based on an operating environment of the display driving device 100, characteristics of a panel connected to the source driver 120, various types of electromagnetic interference which may occur in a signal path between the timing controller 110 and the source driver 120 or the like.

Test data BERT DATA may be randomized by the scrambler 112 to be transferred to the source driver 120. The scrambler 112 may reduce effects of electromagnetic interference and signal delay or the like on signal transmission and reception between the timing controller 110 and the source driver 120.

The source driver 120 may include a receiver 121, a descrambler 122, an RGB decoder 123, an error detector 124, and the like. The receiver 121 may receive randomized test data from the timing controller 110, and the descrambler 122 may derandomize the randomized test data to extract test data BERT DATA. The RGB decoder 123 may calculate pixel data PIXEL DATA corresponding to a source voltage to be supplied to each pixel using test data BERT DATA. In this case, pixel data PIXEL DATA may have predetermined periodicity in a manner similar to test data BERT DATA. The error detector 124 may check periodicity of pixel data PIXEL DATA to determine whether a bit error is present. While the error detector 124 checks periodicity of pixel data PIXEL DATA, the source driver 120 may output a source voltage to the source lines, regardless of checking periodicity of pixel data PIXEL DATA.

The error detector 124 may count aperiodicity occurrences, which indicate a bit error is present whenever the aperiodicity is detected in pixel data PIXEL DATA, and may determine that abnormal conditions occur in the source driver 120 when a number of a counted bit error is greater than a predetermined threshold number. When a single display driving device 100 includes a plurality of source drivers 120, each source driver 120 individually checks a bit error to check whether abnormal conditions occur.

Pixel data PIXEL DATA may have a value for determining a source voltage to be input to a plurality of RGB pixels included in a display panel. As an example embodiment, a single unit pixel in the display panel may include at least three sub-pixels, and each of the three sub-pixels may radiate red light, green light, and blue light, respectively. Pixel data PIXEL DATA may have a value for independently determining sizes of the source voltage to be input to the three sub-pixels. As an example embodiment, a size of a source voltage to be input to each sub-pixel may be determined by a value of pixel data PIXEL DATA, which is within a range of 0 to 255.

Figure 4:
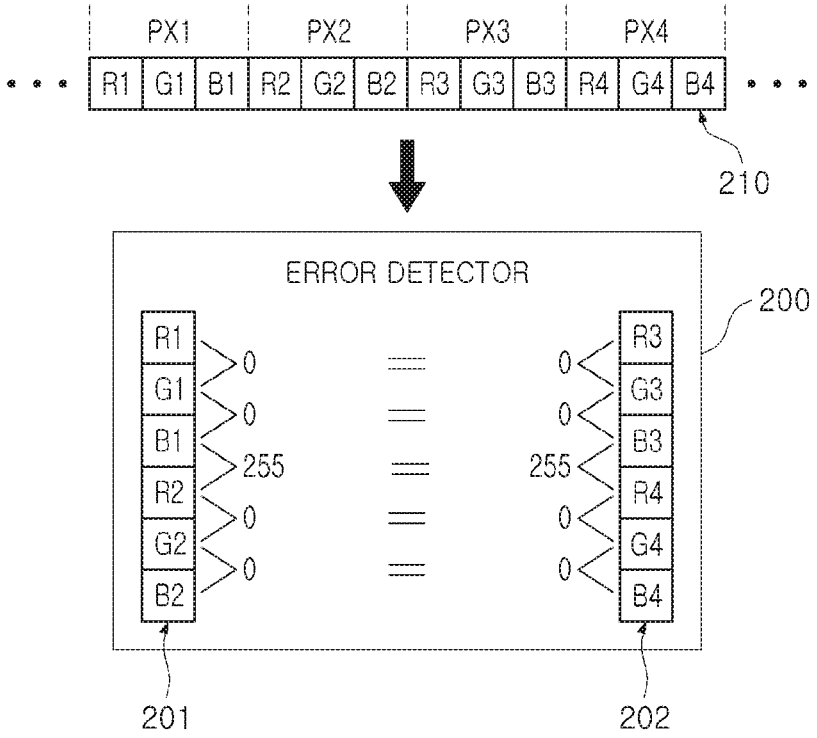
FIGS. 4 and 5 are drawings illustrating operations of a display driving device according to an example embodiment.
Figure 5:
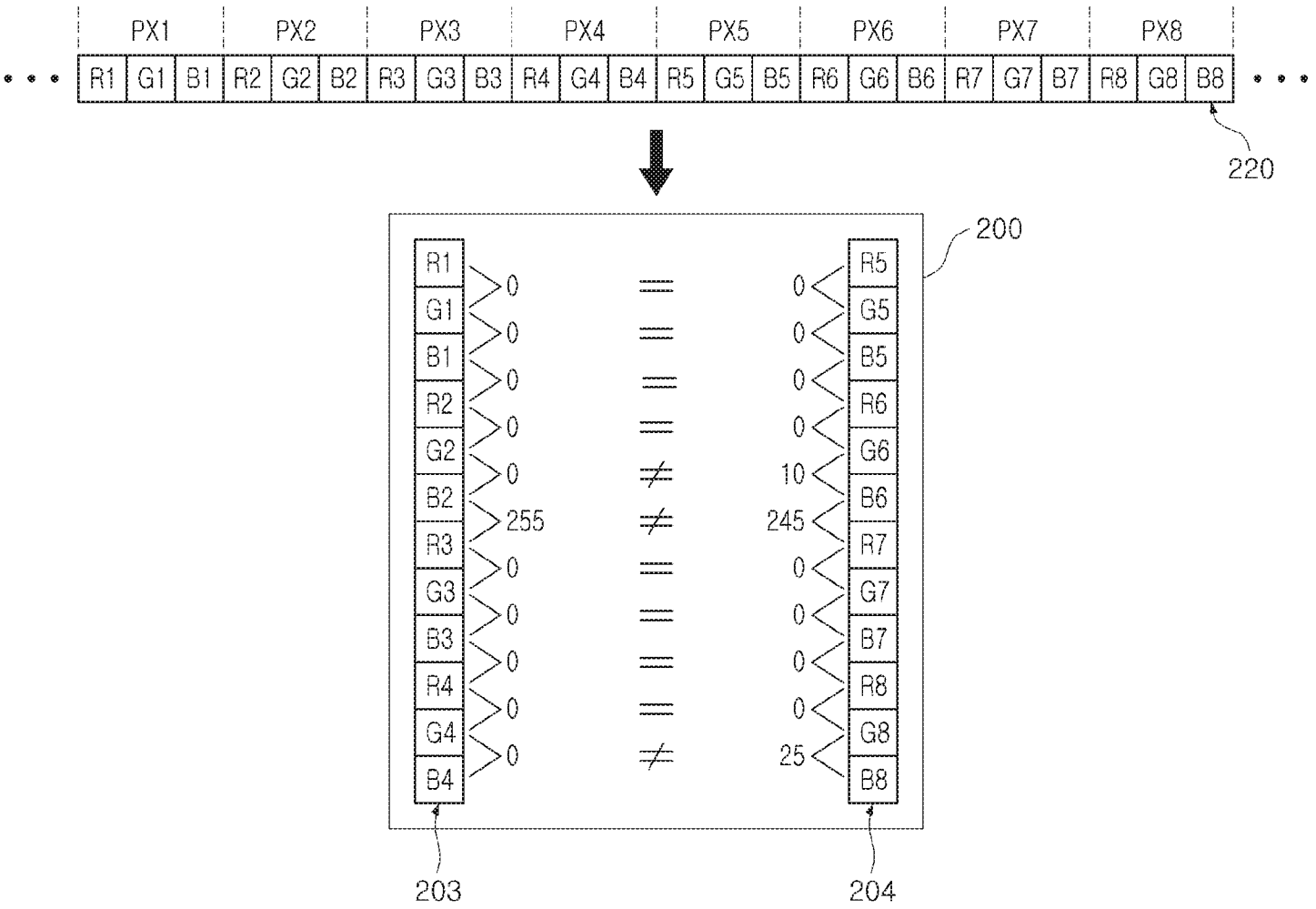

FIGS. 4 and 5 are drawings illustrating operations of a display driving device according to an example embodiment.

With reference to FIG. 4, first pixel data 210 for measuring a bit error rate may be input to an error detector 200. The first pixel data 210 may be data extracted from test data transferred by a timing controller. As an example embodiment, the first pixel data may be data corresponding to the case in which power consumption of a source driver is significantly increased. In an example embodiment, when a source driver outputs a source voltage to a display panel based on the first pixel data 210, a white vertical line and a black vertical line may alternately appear in the display panel. In this case, a value of pixel data corresponding to a sub-pixel included in each pixel PX1, PX2, PX4, and PX4 is described in Table 1.

TABLE 1

| R1 | G1 | B1 | R2 | G2 | B2 | R3 | G3 | B3 | R4 | G4 | B4 |
|---|---|---|---|---|---|---|---|---|---|---|---|
| 0 | 0 | 0 | 255 | 255 | 255 | 0 | 0 | 0 | 255 | 255 | 255 |

When a source voltage is supplied by the first pixel data 210 in Table 1, first and third sub-pixels R1, G1, B1, R3, G3, and B3 may be operated at a highest level of brightness. Meanwhile, second and fourth sub-pixels R2, G2, B2, R4, G4, and B4 may be operated at a lowest level of brightness. Thus, first and third pixels PX1 and PX3 may display white, and second and fourth pixels PX2 and PX4 may display black. As pixels PX1 to PX4 adjacent to each other should receive source voltages having a maximum deviation, a load and power consumption of a source driver may be close to a maximum value.

The error detector 200 may classify successively disposed sub-pixels into a predetermined group, and a difference in a pixel data value corresponding to each sub-pixel may be calculated. The error detector 200 may compare the difference in a pixel data value corresponding to each sub-pixel for each group to determine whether aperiodicity appears in pixel data, and may check a bit error therefrom.

With reference to FIG. 4, the error detector 200 may divide twelve sub-pixels into a first group 201 and a second group 202. Each of the first group 201 and the second group 202 may include six sub-pixels. The error detector 200 may calculate a difference in pixel data values corresponding to sub-pixels adjacent to each other in each of the first group 201 and the second group 202, and calculation results of the first group 201 and the second group 202 may be compared to each other. In an example embodiment illustrated in FIG. 4, as calculation results of the first group 201 and the second group 202 are the same, the error detector 200 may determine that a bit error has not occurred.

Periodicity of pixel data required for measuring a bit error rate is not limited to an example embodiment illustrated in FIG. 4. As described previously, pixel data for measuring a bit error rate may be determined based on test data output by a timing controller, and periodicity of test data may be changed according to characteristics of a display panel, an operating environment of a source driver or the like.

In an example embodiment illustrated in FIG. 5, periodicity of second pixel data 220 received by an error detector may be different from periodicity of the first pixel data 210 according to an example embodiment illustrated in FIG. 4. According to an example embodiment illustrated in FIG. 5, when a source driver outputs a source voltage to a display panel based on the second pixel data 220, a white vertical line and a black vertical line may alternately appear in the display panel. However, in a manner different from an example embodiment in FIG. 4, two adjacent pixels may display white or black together. In an example embodiment illustrated in FIG. 5, a value of pixel data corresponding to a sub-pixel included in each pixel PX1 to PX8 is described in Table 2.

TABLE 2

| R1 | G1 | B1 | R2 | G2 | B2 | R3 | G3 | B3 | R4 | G4 | B4 |
|---|---|---|---|---|---|---|---|---|---|---|---|
| 0 | 0 | 0 | 0 | 0 | 0 | 255 | 255 | 255 | 255 | 255 | 255 |
| R5 | G5 | B5 | R6 | G6 | B6 | R7 | G7 | B7 | R8 | G8 | B8 |
| 0 | 0 | 0 | 0 | 0 | 10 | 255 | 255 | 255 | 255 | 255 | 230 |

When a source voltage is supplied by the second pixel data 220, first and second pixels, PX1 and PX2, adjacent to each other may display white, and third and fourth pixels, PX3 and PX4, may display black. In a manner similar thereto, fifth and sixth pixels, PX5 and PX6, may display white, and seventh and eighth pixels, PX7 and PX8, may display black. In other words, periodicity of the second pixel data 220 may differ from periodicity of the first pixel data 210. In this case, different periodicity may occur in a worst case situation due to an operating environment of a source driver, or characteristics of a display panel connected to a source driver, electromagnetic waves affecting a signal channel between a timing controller and a source driver, an interference signal or the like.

The error detector 200 may classify successively disposed sub-pixels into a first group 203 and a second group 204, and a difference in a pixel data value corresponding to each sub-pixel is calculated to be compared. In an example embodiment illustrated in FIG. 5, as a result of calculation and comparison, a total of three differences may occur, whereby the error detector 200 may determine a total of three bit errors occur.

Figure 6:
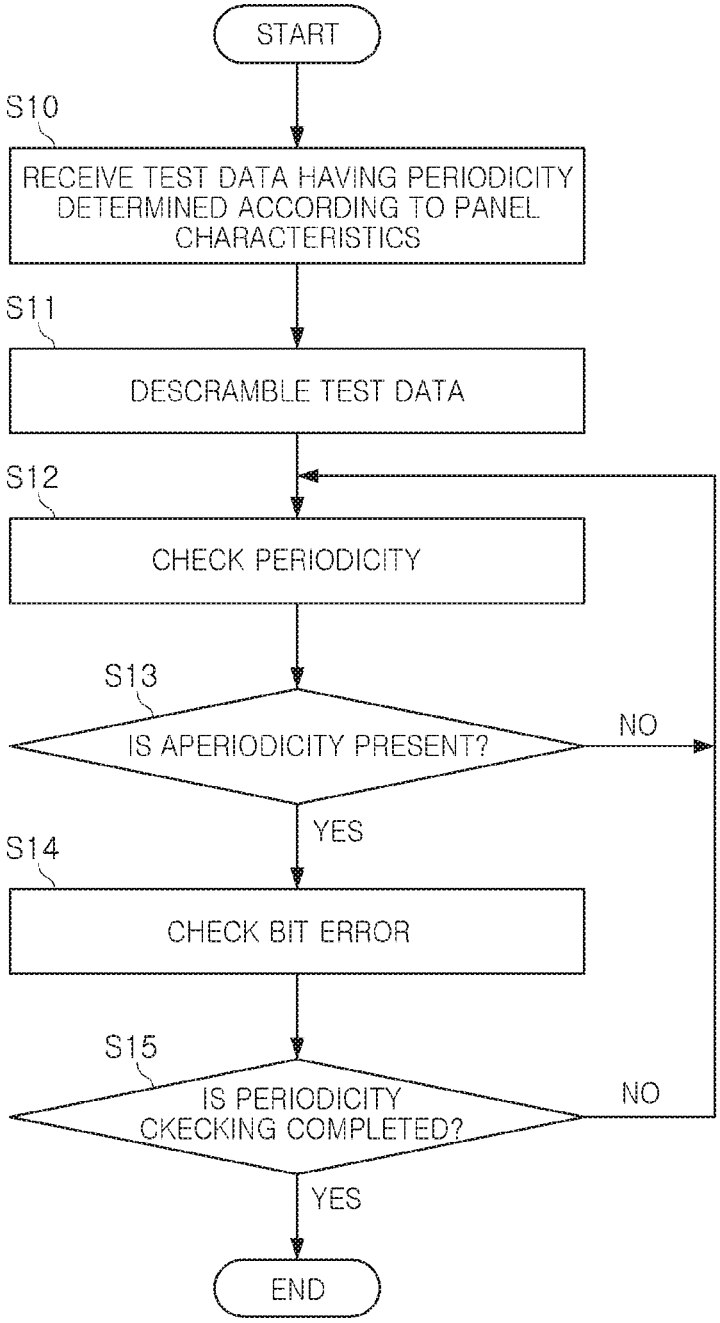
FIG. 6 is a flow chart illustrating operations of a display driving device according to an example embodiment.

FIG. 6 is a flow chart provided to illustrate operations of a display driving device according to an example embodiment. Hereinafter, the operations thereof will be described with reference to FIG. 6, along with FIG. 3, for convenience of explanation.

With reference to FIG. 6, operations of a display driving device according to an example embodiment may be started by receiving test data BERT DATA by the source driver 120 (S10). The source driver 120 may receive test data BERT DATA from the timing controller 110. As an example embodiment, test data BERT DATA transmitted by the timing controller 110 may be data randomized by the scrambler 112, and may be descrambled by the descrambler 122 of the source driver 120 (S11).

The source driver 120 may check periodicity of test data BERT DATA (S12). The periodicity of test data BERT DATA may be checked by extracting pixel data PIXEL DATA for defining a source voltage to be input to each sub-pixel of a display panel from test data BERT DATA, and inspecting periodicity of pixel data PIXEL DATA.

Periodicity of pixel data PIXEL DATA may be checked in a manner similar to an example embodiment illustrated in FIG. 4 or FIG. 5. For example, the error detector 124 may classify pixel data PIXEL DATA into a plurality of groups according to periodicity of pixel data PIXEL DATA. The error detector 124 may calculate a difference in pixel data values corresponding to sub-pixels adjacent to each other inside each group, and compare the difference therein for each group to determine whether aperiodicity appears (S13).

The error detector 124 may check the case in which aperiodicity appears to be a bit error (S14). As an example embodiment, the error detector 124 may count a number of a bit error occurring. When the number of a bit error occurring is greater than a predetermined threshold value, a source driver 120 corresponding thereto may be determined to be a defect in which a bit error rate exceeds a measurement limit. The error detector 124 may determine whether periodicity is checked in pixel data corresponding to all sub-pixels, thereby determining whether bit error rate measuring is finished (S15).

As a result of bit error rate measuring, in the case in which a specific source driver 120 is determined to be defective or operating under abnormal conditions, for example, a locking defect or the like occur in the source driver 120 during operations of the display driving device 100, a state of a source driver 120 corresponding thereto may be required to be provided to the timing controller 110. When a single display driving device 100 includes a plurality of source drivers 120, the plurality of source drivers 120 may be connected to the timing controller 110 through a single shared back channel (SBC). Each of the plurality of source drivers 120 may include a transistor connected to a shared back channel in an open drain method. Thus, when a value of a shared back channel is set to be low in the case in which an abnormality occurs in a single source driver 120, the timing controller 110 may not specify a source driver 120 in which an abnormal state or a performance defect or the like occurs, but may recognize only that an abnormality occurs in at least one of the plurality of source drivers 120 by simply detecting that a value of a shared back channel is changed to be low. Hereinafter, with reference to FIGS. 7 to 11, an example embodiment for solving a problem described above will be described.

Figure 7:
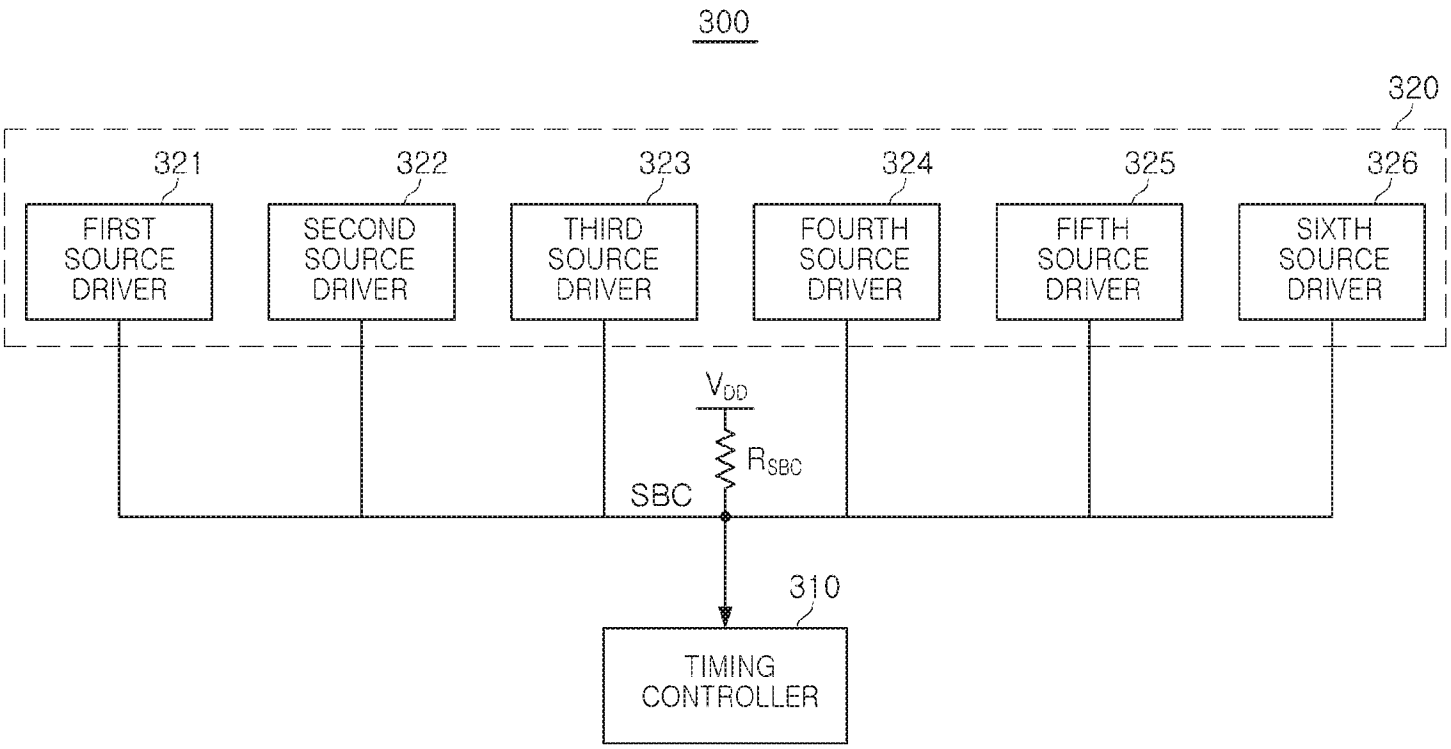
FIG. 7 is a block diagram illustrating a display driving device according to an example embodiment.

FIG. 7 is a block diagram illustrating a display driving device according to an example embodiment.

With reference to FIG. 7, a display driving device 300 according to an example embodiment may include a timing controller 310 and a source driver 320. The source driver 320 may include first to sixth source drivers 321 to 326, and the first to sixth source drivers 321 to 326 may be disposed in parallel with each other. The first to sixth source drivers 321 to 326 may be connected to different source lines, and may be connected to the timing controller 310 through a single SBC.

To share the SBC, each of the first to sixth source drivers 321 to 326 may include a transistor connected to the SBC in an open drain or open collector method. The SBC may be connected to a power voltage $V_{DD}$ through pull-up resistance $R_{SBC}$, and may be changed to have a low value in a case in which abnormal conditions occur in at least one of the first to sixth source drivers 321 to 326.

The first to sixth source drivers 321 to 326 share a single SBC. In the case in which an abnormal state or a performance defect or the like is detected in at least one of the first to sixth source drivers 321 to 326, when the SBC is changed to have a low value, the timing controller 310 may not specify a source driver, of the first to sixth source drivers 321 to 326, in which the abnormal state or the performance defect or the like occurs. In an example embodiment, in the case in which an abnormal state or a performance defect or the like occurs in at least one of the first to sixth source drivers 321 to 326, before a value of an SBC is changed to be low, a source driver corresponding thereto transmits identification information to the timing controller 310 in advance to identify the source driver. Hereinafter, operations of a display driving device will be described with reference to FIGS. 8 to 11.

FIGS. 8 to 11 are drawings provided to illustrate operations of a display driving device according to an example embodiment.

Figure 8:
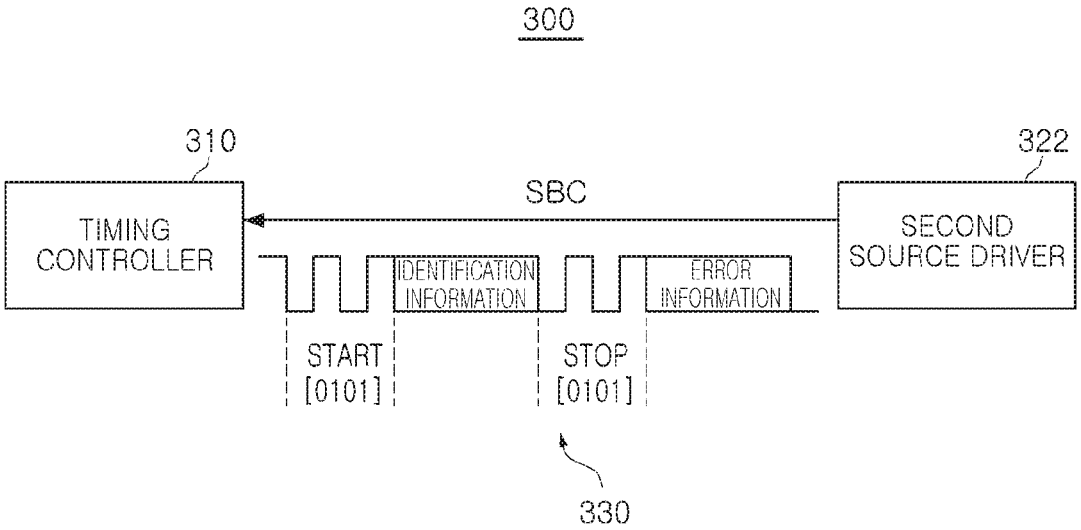
FIGS. 8 through 11 are drawings illustrating operations of a display driving device according to an example embodiment.

An example embodiment illustrated in FIG. 8 may correspond to the case in which an abnormal state or a performance defect or the like occurs in a second source driver 322. The abnormal state or the performance defect of the second source driver 322 may be determined from a bit error rate measured by an interface or locking inspection of a phase clock of a source driver or the like.

When the abnormal state or the performance defect or the like is determined, the second source driver 322 may transmit a signal 330 containing identification information for identifying the second source driver to the timing controller 310. A protocol of the signal 330 may include a preamble START for notifying a transmission start, and a postamble END for notifying identification information regarding the second source driver 322 in which an abnormal state or a performance defect occurs, and a transmission end. The preamble START and the postamble END may have a bit sequence defined in advance between the second source driver 322 and the timing controller 310. As an example embodiment, each of the preamble START and the postamble END may include 4-bit data. In an example embodiment illustrated in FIG. 8, the preamble START and the postamble END are exemplified as having data of [0101], but are not limited thereto.

Identification information regarding the second source driver 322 may be inserted between the preamble START and the postamble END. The timing controller 310 may specify a source driver in which an abnormal state or performance defect occurs using identification information inserted between the preamble START and the postamble END. When transmission of the postamble END is completed, the second source driver 322 may convert a value of an SBC to be low. When a value of an SBC is detected to be converted to be low after identification information regarding the second source driver 322 is received, the timing controller 310 may determine that an abnormal state or a performance defect has occurred in the second source driver 322.

When a performance defect or an abnormal state occurring in the second source driver 322 is specified, the timing controller 310 may selectively redrive or reset only the second source driver 322. Thus, reducing the time required for system performance analysis, and only a selected source driver is redriven or reset to quickly improve visibility of a defective screen.

In an example embodiment, a plurality of source drivers 321 to 326 may be connected to the timing controller 310 while sharing a single SBC. Thus, in the case in which an abnormal state or a performance defect occurs in two or more of the plurality of source drivers 321 to 326 at the same time, or at approximately the same time, values of identification information transmitted by two or more of the plurality of source drivers 321 to 326 may overlap with each other. Thus, whereby the timing controller 310 may not be able to specify a source driver of the plurality of source driver 321 to 326 in which the abnormal state or the performance defect occurs.

To solve a problem described above, in an example embodiment, values of identification information applied to the plurality of source drivers 321 to 326 may be determined according to priority of each of the plurality of source drivers 321 to 326. As the values of identification information are applied based on the priority, when identification information is transmitted by two or more of the plurality of source drivers 321 to 326 at the same time or at approximately the same time, identification information regarding a source driver having a higher priority may be redriven or reset in advance. Hereinafter, operations of a display driving device will be described with reference to FIGS. 9 to 11.

Figure 9:
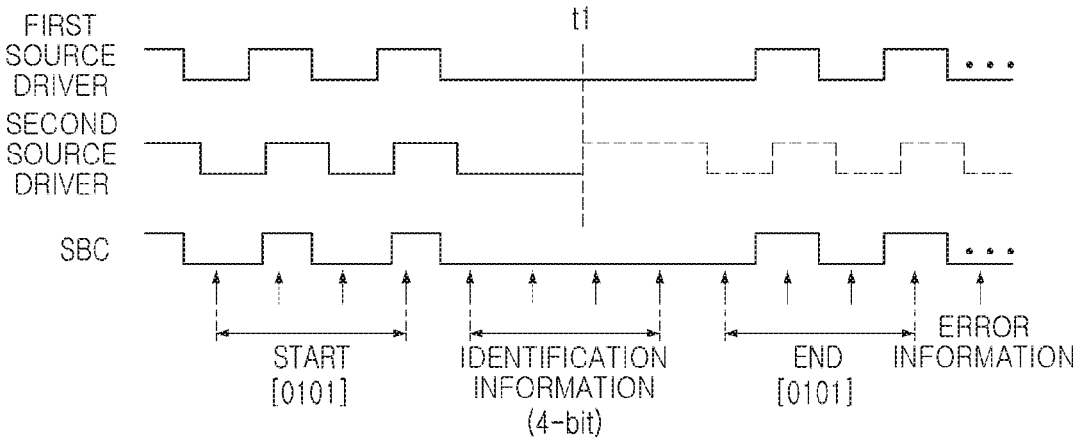
Figure 10:
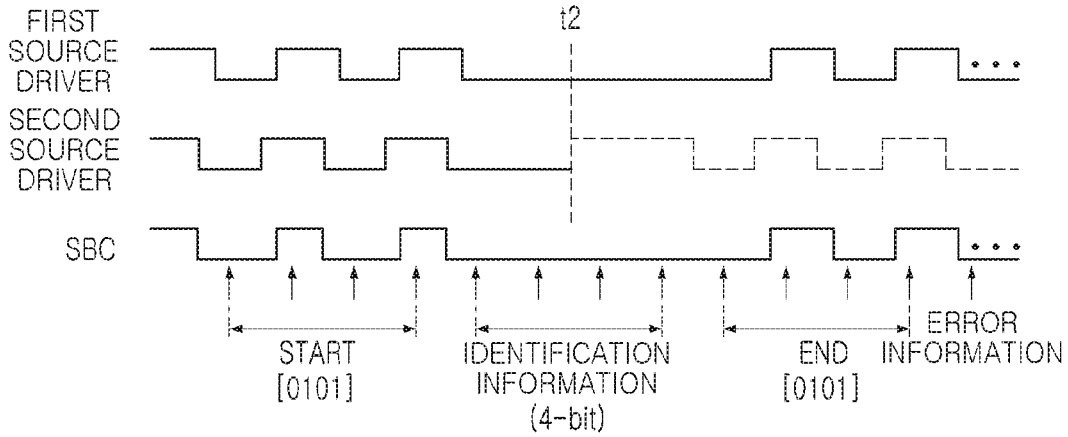

An example embodiment illustrated in FIGS. 9 and 10 may correspond to the case in which each of a first source driver 321 and a second source driver 322 may detect an abnormal state or a performance defect almost at the same time. With reference to FIG. 9, the first source driver 321 may detect an abnormal state or a performance defect earlier than the second source driver 322, and may transmit preamble START consisting of 4-bit data to the timing controller 310. Subsequently, the second source driver 322 may begin to transmit preamble START.

When transmission of preamble START is completed, each of the first source driver 321 and the second source driver 322 may begin to transmit identification information. In example embodiments illustrated in FIGS. 9 and 10, identification information regarding each of the plurality of source drivers 321 to 326 may be 4-bit data. In addition, identification information regarding the first source driver 321 may be [0000], and identification information regarding the second source driver 322 may be [0011].

Each of the first source driver 321 and the second source driver 322 may be connected to the timing controller 310 through a single SBC. Thus, when output of one source driver of the first source driver 321 and the second source driver 322 is low, the other source driver thereof may detect the low output through a transistor connected to a SBC in an open drain type. At a time t1 in which the second source driver 322 desires to convert a value of a SBC to be high so as to transmit identification information [0011] of the second source driver, the second source driver 322 may detect a value of a SBC, fixed to be low by transmission of identification information [0000] of the first source driver 321.

At the time t1, the second source driver 322, after detecting that identification information [0000] of the first source driver 321 is transmitted, may stop transmission of identification information [0011] of the second source driver according to the relatively lower priority. So as to allow normal transmission and reception of identification information [0000] of the first source driver 321 with relatively higher priority, the second source driver 322 may perform an arbitration function. In an example embodiment, in order to smoothly perform transmission of identification information according to priority, identification information applied to a source driver having high priority may have a value lower than that of identification information applied to a source driver having low priority. For example, when a fifth source driver 325 has priority lower than that of the first source driver 321 and higher than that of the second source driver 322, identification information regarding the fifth source driver 325 may be determined as [0001].

With reference to FIG. 10, in a manner different from FIG. 9, the second source driver 322 may transmit identification information to the timing controller 310 before the first source driver 321. The second source driver 322 may complete transmission of preamble START and may begin to transmit identification information earlier than the first source driver 321. Values of identification information regarding the first source driver 321 and the second source driver 322 may be [0000] and [0011], respectively, in a manner similar to an example embodiment illustrated in FIG. 9.

The second source driver 322 may change a value of a SBC to be high at a time t2 so as to transmit identification information [0011]. However, as illustrated in FIG. 10, while the first source driver 321 transmits identification information [0000], a value of the SBC may be fixed to be low at the time t2. At the time t2, the second source driver 322 may detect a value of an SBC fixed to be low and recognize that identification information [0000] of the first source driver 321 is transmitted to the timing controller 310, and may stop transmission of identification information [0011] of the second source driver. Thus, even when the second source driver 322 having low priority detects an abnormal state or a performance defect or the like in advance, the timing controller 310 may preferentially recognize an abnormal state, a performance defect or the like of a higher priority source driver, such as the first source driver 321.

In example embodiments illustrated in FIGS. 9 and 10, after the first source driver 321 transmits identification information [0000] and postamble END, the first source driver may maintain a value of a SBC to be low. After the timing controller 310 receives [0000], which is identification information regarding the first source driver 321, and the postamble END, the timing controller may detect that an abnormal state, a performance defect or the like has occurred in the first source driver 321 through a SBC maintaining a low value, and may redrive or reset the first source driver 321.

Figure 11:
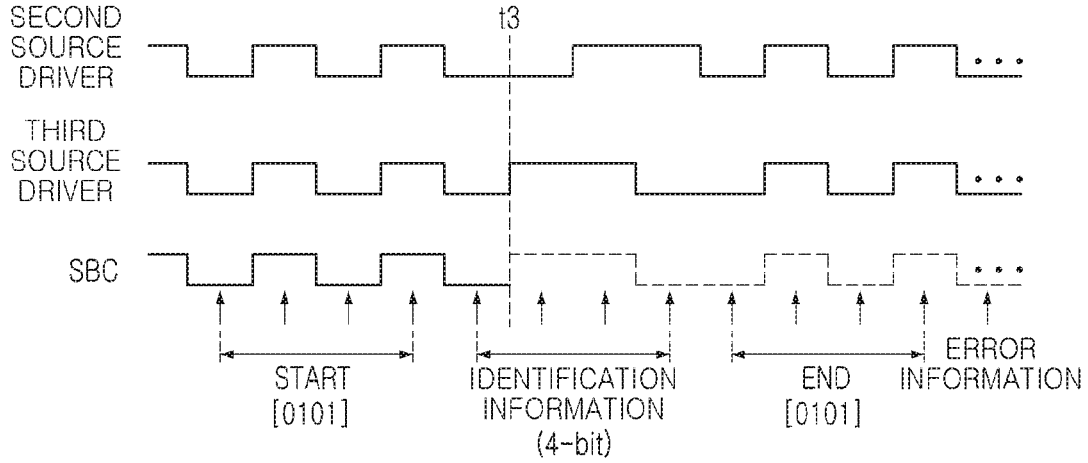

With reference to FIG. 11, abnormal states or performance defects may occur in a second source driver 322 and a third source driver 323 at the same time. Thus, the second source driver 322 and the third source driver 323 may begin to transmit preamble START through a SBC, and values of identification information regarding the second source driver 322 and the third source driver 323 may be transmitted at the same time. The values of identification information regarding the second source driver 322 and the third source driver 323 may be [0011] and [0110], respectively.

In other words, identification information regarding the second source driver 322 may have a value less than that of identification information regarding the third source driver 323. In this case, the second source driver 322 may have priority higher than that of the third source driver 323. With reference to FIG. 11, the third source driver 323 may change a value of an SBC to be high at a time t3, so as to transmit identification information [0110].

In an example embodiment illustrated in FIG. 11, as identification information [0011] of the second source driver 322 is transmitted, a value of an SBC at the time t3 is maintained to be low. The third source driver 323 may detect a value of the SBC maintained to be low at the time t3 to recognize that the second source driver 322 transmits identification information. Thus, the third source driver 323 may stop transmission of identification information after the time t3, and the timing controller 310 may only receive identification information regarding the second source driver 322 having relatively high priority. After transmission of postamble END is completed, when a value of an SBC is maintained to be low, the timing controller 310 may determine that an abnormal state or a performance defect or the like has occurred in the second source driver 322 based on received identification information [0011], and thus, may redrive or reset the second source driver 322.

In other words, in an example embodiment, values of identification information may be applied to the plurality of source drivers 321 to 326 in consideration of priority of each of the plurality of source drivers 321 to 326. For example, while a source driver of the plurality of source drivers 321 to 326 has higher priority, identification information having a lower value may be applied to the source driver. While a source driver of the plurality of source drivers 321 to 326 has lower priority, identification information having a greater value may be applied to the source driver. In this case, the plurality of source drivers 321 to 326 may be connected to a single SBC in an open drain structure. When a structure in which the plurality of source drivers 321 to 326 are connected to the SBC is changed, a relationship between priority and identification information may be also changed.

As set forth above, according to example embodiments, a timing controller may generate test data in which at least one of various operating environments of a display driving device and characteristics of a panel connected to a display driving device is reflected to be transmitted to a source driver, and the source driver may inspect periodicity of test data to measure a bit error rate. As identification information regarding a source driver in which abnormal conditions or a performance defect have occurred is transmitted to a timing controller through a shared back channel, the timing controller may effectively specify the source driver in which abnormal conditions occur.

As is traditional in the field, example embodiments are described, and illustrated in the drawings, in terms of functional blocks, units and/or modules. Those skilled in the art will appreciate that these blocks, units and/or modules are physically implemented by electronic (or optical) circuits such as logic circuits, discrete components, microprocessors, hard-wired circuits, memory elements, wiring connections, and the like, which may be formed using semiconductor-based fabrication techniques or other manufacturing technologies. In the case of the blocks, units and/or modules being implemented by microprocessors or similar, they may be programmed using software (e.g., microcode) to perform various functions discussed herein and may optionally be driven by firmware and/or software. Alternatively, each block, unit and/or module may be implemented by dedicated hardware, or as a combination of dedicated hardware to perform some functions and a processor (e.g., one or more programmed microprocessors and associated circuitry) to perform other functions. Also, each block, unit and/or module of the embodiments may be physically separated into two or more interacting and discrete blocks, units and/or modules without departing from the scope of the present disclosure. Further, the blocks, units and/or modules of the example embodiments may be physically combined into more complex blocks, units and/or modules without departing from the scope of the present disclosure.

While example embodiments have been shown and described above, it will be apparent to those skilled in the art that modifications and variations could be made without departing from the scope of the present disclosure as defined by the appended claims.

What is claimed is:

1. A display driving device comprising:

a timing controller configured to generate test data having a predetermined periodicity; and a source driver configured to drive source lines of a display panel using the test data, determine that a bit error has been generated when aperiodicity appears in the test data, and measure a bit error rate based on the bit error, wherein the timing controller is further configured to generate the test data based on at least one among characteristics of the display panel, characteristics of the source driver, an operating environment of the display panel and an operating environment of the source driver.

2. The display driving device of claim 1, wherein in response to the timing controller generating the test data, a load of the source driver is increased to a maximum value while the source driver drives the source lines using the test data.

3. The display driving device of claim 2, wherein power consumption of the source driver has a maximum value while driving the source lines using the test data.

4. The display driving device of claim 1, wherein the source driver includes a communication interface connected to the timing controller and configured to measure the bit error rate using the test data.

5. The display driving device of claim 4, wherein the communication interface is further configured to determine that the source driver is defective when a number of bit errors detected from the test data exceeds a predetermined threshold number.

6. The display driving device of claim 1, wherein the source driver is further configured to extract pixel data for the source lines from the test data, calculate a difference in the pixel data for each of the source lines adjacent to each other in the display panel, and determine aperiodicity of the test data based on the difference in the pixel data for each of the source lines adjacent to each other in the display panel.

7. The display driving device of claim 1, wherein the source driver includes a plurality of source drivers, and each of the plurality of source drivers is configured to measure the bit error rate from the test data, and determine whether abnormal conditions occur based on the bit error rate.

8. The display driving device of claim 7, wherein each of the plurality of source drivers are connected to the timing controller through a single shared back channel.

9. The display driving device of claim 8, wherein each of the plurality of source drivers is configured to transmit corresponding identification information to the timing controller through the single shared back channel when the abnormal conditions are determined to have occurred.

10. A display driving device comprising:

a timing controller configured to generate test data having a predetermined periodicity; and a source driver configured to drive source lines of a display panel using the test data, identify that a bit error has been generated based on aperiodicity appearing in the test data, and measure a bit error rate based on the bit error, wherein the test data having the predetermined periodicity is configured to control the display panel to alternately display a plurality of white vertical lines and a plurality of black vertical lines, and the timing controller is further configured to generate the test data based on at least one among characteristics of the display panel, characteristics of the source driver, an operating environment of the display panel and an operating environment of the source driver.

11. The display driving device of claim 10, wherein the source driver is further configured to extract pixel data for the source lines from the test data, classify the pixel data into a first group and a second group, identify a corresponding difference in the pixel data in the first group and corresponding pixel data in the second group, and identify aperiodicity of the test data based on the corresponding difference in the pixel data.

12. A method of a display driving device, the method comprising:

generating test data having a predetermined periodicity, the test data is generated based on at least one among characteristics of a display panel, characteristics of a source driver, an operating environment of the display panel and an operating environment of the source driver;

driving source lines of the display panel using the test data;

identifying that a bit error has been generated based on aperiodicity appearing in the test data; and identifying a bit error rate based on the bit error.

* * * * *